United States Patent [19]

Davis et al.

[11] Patent Number: 4,904,364

[45] Date of Patent: Feb. 27, 1990

[54] ANODE ASSEMBLY FOR SELECTIVELY PLATING INTERIOR SURFACES OF ELECTRICAL TERMINALS

[75] Inventors: Thomas F. Davis, Camp Hill; Richard M. Wagner, Harrisburg, both of Pa.

[73] Assignee: AMP Incorporated, Harrisburg, Pa.

[21] Appl. No.: 275,812

[22] Filed: Nov. 23, 1988

[51] Int. Cl.[4] ..... C25D 17/12

[52] U.S. Cl. ..... 204/224 R; 204/280; 204/225

[58] Field of Search ..... 204/224 R, 279, 288, 204/289, 290 R, 280, 225

[56] References Cited

U.S. PATENT DOCUMENTS

| | | | |
|---|---|---|---|
| 2,929,769 | 3/1960 | Newell et al. | 204/290 R |
| 3,650,912 | 3/1972 | Plehal | 204/289 X |
| 4,370,211 | 1/1983 | Hybler | 204/289 X |
| 4,384,926 | 5/1983 | Wagner | 204/26 |
| 4,427,498 | 1/1984 | Wagner | 204/26 |
| 4,555,321 | 11/1985 | Wicks | 204/224 R |
| 4,690,747 | 9/1987 | Smith et al. | 204/206 |

*Primary Examiner*—Donald R. Valentine
*Attorney, Agent, or Firm*—Katherine A. Nelson

[57] ABSTRACT

An anode assembly 30 for selectively plating contact areas 102 on the interior surface of cathodically charged socket terminals 96 is disclosed, which comprises a conductive body member 32 having an anode means or member 54 extending forwardly from a body section 38, a dielectric body member 58 adapted to be secured to a forward portion 34 of said conductive body member 32 and having a passageway 62 therethrough for receiving the anode means 54; sheath means 64 extending forwardly from the dielectric body member and along the anode means 54 and extending angularly around at least one selected circumferential portion thereof, and lateral edge surfaces 68 of the sheath means 64 defining at least one slot 70 extending axially along the anode means 54 such that at least one axially extending portion 55 of the anode means 54 is exposed along the slot 70, the sheath means 64 having a diameter smaller than the inner diameter of a terminal 96 to be plated; and means for securing said dielectric body member 58 to said forward portion 34 of said conductive body member 32. Upon moving the sheathed anode means 54 into the interior of an electrical terminal 96, supplying plating solution upon the exposed anode portion 55 of the anode means 54, and providing an electrical current flow from the anode means 54, through the plating solution and into the cathodically charged terminal 96, a layer of plating is selectively deposited on the internal surface portion 102 of the terminal 96 that is generally aligned with the at least one exposed anode portion 55, the sheath means 64 providing a barrier to prevent plating on the remaining internal terminal surface portions.

10 Claims, 7 Drawing Sheets

ANODE ASSEMBLY FOR SELECTIVELY PLATING INTERIOR SURFACES OF ELECTRICAL TERMINALS

FIELD OF THE INVENTION

The present invention relates to selective electroplating of electrical terminals, i.e., electroplating only the electrical contact surfaces of the terminals to the exclusion of other surfaces of the terminals and, in particular, to selectively plating terminals that are attached to a carrier strip.

BACKGROUND OF THE INVENTION

In one method of manufacturing electrical terminals, the terminals are stamped and formed from metal strip and are attached to a carrier strip. The carrier strip is useful for strip feeding the terminals through successive manufacturing operations. One of the necessary manufacturing operations involves plating, i.e., electroplating the electrical contact surfaces of the strip fed terminals with a contact metal, usually noble metals or noble metal alloys. These metals are characterized by good electrical conductivity and little or no formation of oxides that reduce the conductivity. Therefore, these metals, when applied as plating will enhance conductivity of the terminals. The high cost of the metals has necessitated precision deposition of these metals on the contact surfaces of the terminals, and not on the remaining surfaces of the terminals.

Plating apparatus, also known as a plating cell, includes an electrical anode, an electrical cathode comprised of the strip fed terminals, and a plating solution, i.e., an electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the cathodic terminals. The metal ions deposit as metal plating on those terminal surfaces in contact with the plating solution.

U.S. Pat. Nos. 4,690,747, 4,384,926, 4,427,498 and 4,555,321, owned by this assignee, disclose plating apparatus in which the interior surfaces of strip fed terminals are plated by supplying plating fluid through nozzles and over associated anode extensions or assemblies that are mounted for reciprocation into and out of the interiors of terminals. In effect, each anode extension, nozzle and terminal is a plating cell, and each apparatus comprises a plurality of plating cells. In the first three patents above, the anode extensions are mounted within their associated nozzles. In the fourth patent above, the anode extensions are mounted separately and apart from the nozzles and enter the terminals from a different direction than that of the plating fluid.

The apparatus disclosed in the four referenced patents are designed to be used with stamped and formed terminals, wherein the contact zone is located on the inside surface of a formed terminal. To selectively plate the contact zone the anode extension must be moved inside the terminal. The anode extensions disclosed and used in the above apparatus are particularly suitable for use with electrical socket terminals having a contact area that extends circumferentially around or along the entire inner surface. In some types of socket terminals, however, the contact area comprises only an angular portion of the inner surface of the terminal. In those instances, it is desirable to have a means for selectively plating only that portion of the inner surface that comprises the contact area.

SUMMARY OF THE INVENTION

Accordingly, it is an object of the present invention to provide an anode assembly for plating selected contact areas within socket terminals in which the anode member is concentrically disposed within the socket terminals.

It is an object of the invention to provide a means whereby a selected angular portion of the inside diameter of a socket terminal may be plated to the exclusion of the remaining interior portions.

It is an additional object of the present invention to provide an anode assembly with means for aligning a contact terminal for engagement with the anode of the assembly.

It is a further object of the invention to provide a means for protecting an anode member from misalignment in the terminal.

It is another object of the invention to provide a means for preventing electrical shorting between the anode member and the terminal being plated.

Furthermore it is an object of the invention to provide a cost effective means for selectively plating contact areas of socket terminals while eliminating plating in areas where it is not needed.

The present invention is directed to an anode assembly for selectively plating contact areas within socket terminals. It is designed to be used in plating apparatus of the type disclosed in the U.S. patents cited above; and more particularly in the apparatus disclosed in co-pending U.S. Patent Ser. No. 07/276,171, entitled Improved Plating Apparatus filed concomitantly herewith and incorporated by reference herein.

In accordance with the invention, the anode assembly for selectively plating contact areas of interior surfaces of socket terminals comprises a conductive body member having an anode means extending forwardly from a body section, a dielectric body member adapted to be secured to the conductive body member, sheath means extending forwardly from the dielectric body member and along the anode means and extending angularly around at least one selected circumferential portion thereof, lateral edge surfaces of the sheath means defining at least one slot extending axially along the anode means and means for securing the dielectric member to the conductive body member. The body section includes a reference surface related to the anode means, the anode means being concentric with the reference surface. The dielectric body member is adapted to be secured to a forward portion of the conductive body member, and preferably including the reference surface. The dielectric body member has a passageway extending therethrough for receiving the anode means. The forwardly extending sheath means portion is concentric with the conductive reference surface. The at least one slot in the sheath extends along the sheathed anode means such that at least one axially extending portion of the anode means is exposed along the slot. The sheath means has a diameter smaller than the inner diameter of a terminal to be plated.

When the dielectric body member is secured to the conductive forward portion, the sheath means extends. Upon moving the sheathed anode means into an electrical terminal, supplying plating solution upon the exposed anode portion of the anode means, and providing an electrical current flow from the anode means, through the solution and into the cathodic terminal, a layer of plating is selectively deposited on an internal surface portion of the terminal that is generally aligned with said at least one exposed anode portion. The sheath means thus providing a barrier to prevent plating on the remaining internal terminal surface.

The present invention is also related to an electrical receptacle terminal that has a selected angular portion of its interior plated with a precious or semi-precious metal layer in conjunction with the anode assembly of the present invention. The plated layer has observable characteristics that distinguish the plating as applied by apparatus or a process other than the one described herein.

A further aspect of this invention is directed to a means for biasing individual anode assemblies which cooperates with means in the apparatus to store energy in the biasing means while the anode assembly is in a retracted position, to retain the assembly in a retracted position until a terminal to be plated is moved into position forwardly of the assembly and anode member, and to urge the biased assembly forward such that the anode means enters the interior of the terminal to be plated. The stored energy of the biasing means thus provides a sufficient insertion force. In the preferred embodiment, the means includes a spring member and a cam tracking roller which cooperate with a camming means of the apparatus to provide the insertion force for the anode means.

The invention itself, together with further objects and its attendant advantages, will best be understood by reference to the following detailed description, taken in conjunction with the accompanying drawings.

DETAILED DESCRIPTION OF THE DRAWINGS

Figures 1, 2:
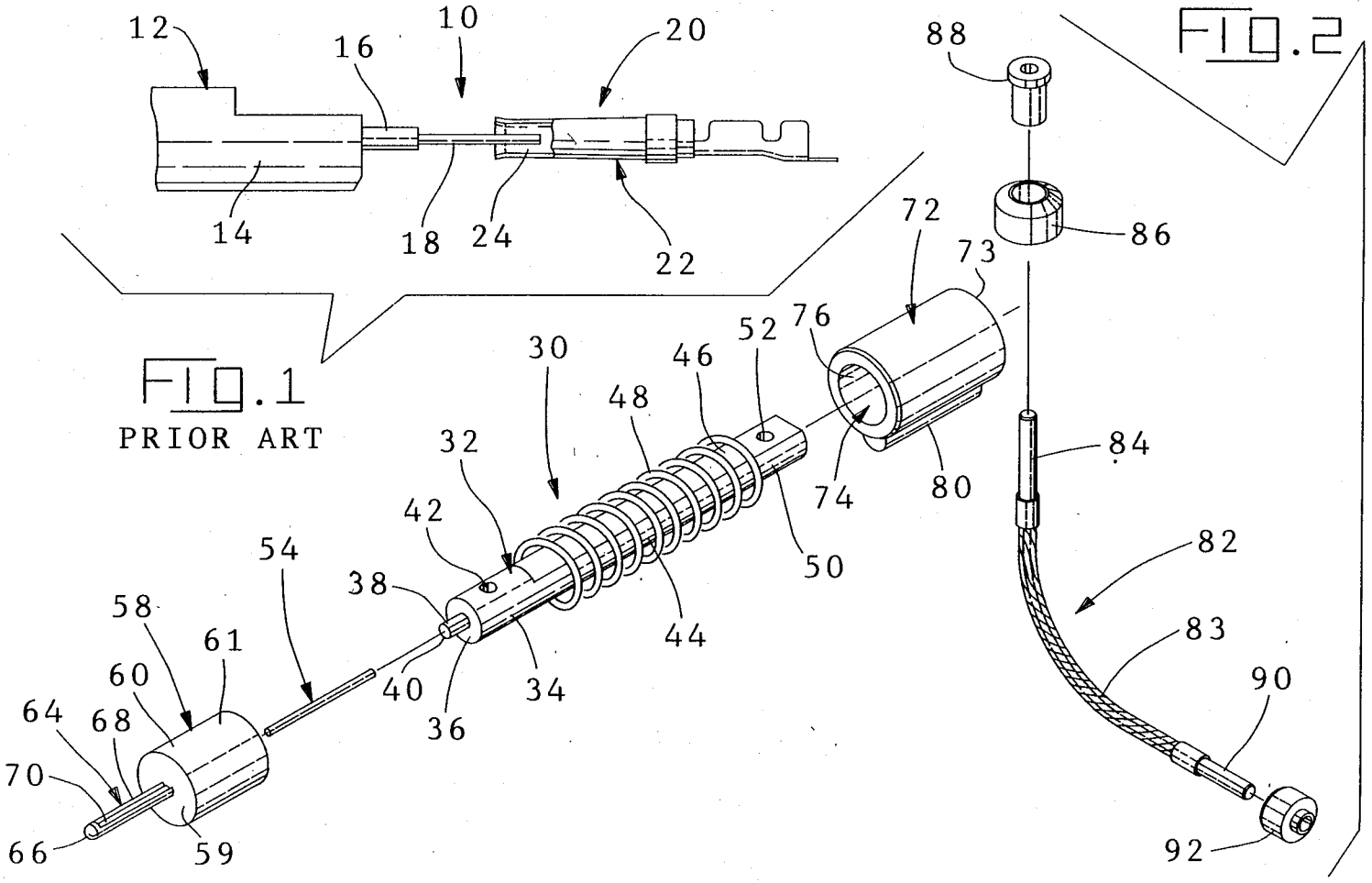
FIG. 1 PRIOR ART
FIG. 1 is a partially sectioned view of a front portion prior art anode assembly.
FIG. 2 is an exploded view of the anode assembly of the present invention.

FIG. 1 shows an anode assembly 10 used in the prior art. Anode assembly 10 is comprised of a body member 12 having a forward portion 14 and an reduced diameter section 16 and conductive anode member 18 extending from reduced diameter section 16. Anode assembly 10 is designed to be used with an electrical terminal 20 having a socket or a barrel portion 22 with a passageway 24 therein. When used in a plating apparatus, anode member 18 is inserted into passageway 24 of terminal member 20. A layer of plating is deposited on the internal surface of terminal 22 in the area surrounding anode member 18 and to a depth essentially equivalent to the distance anode member 18 is inserted into terminal 20.

Figure 2A:
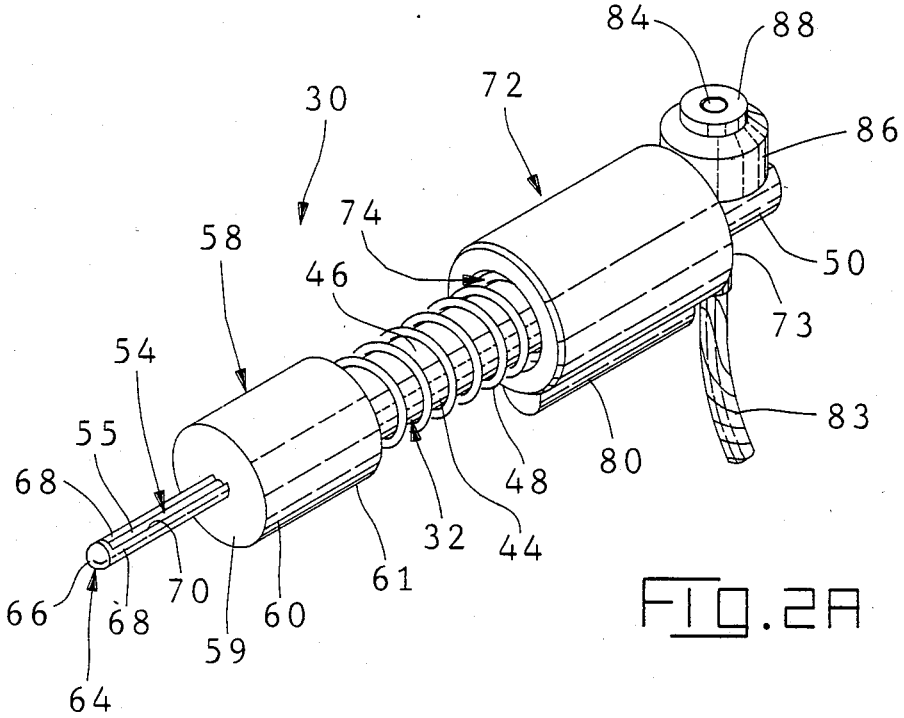
FIG. 2A is a perspective view of the assembled anode assembly of FIG. 2.
Figure 3:
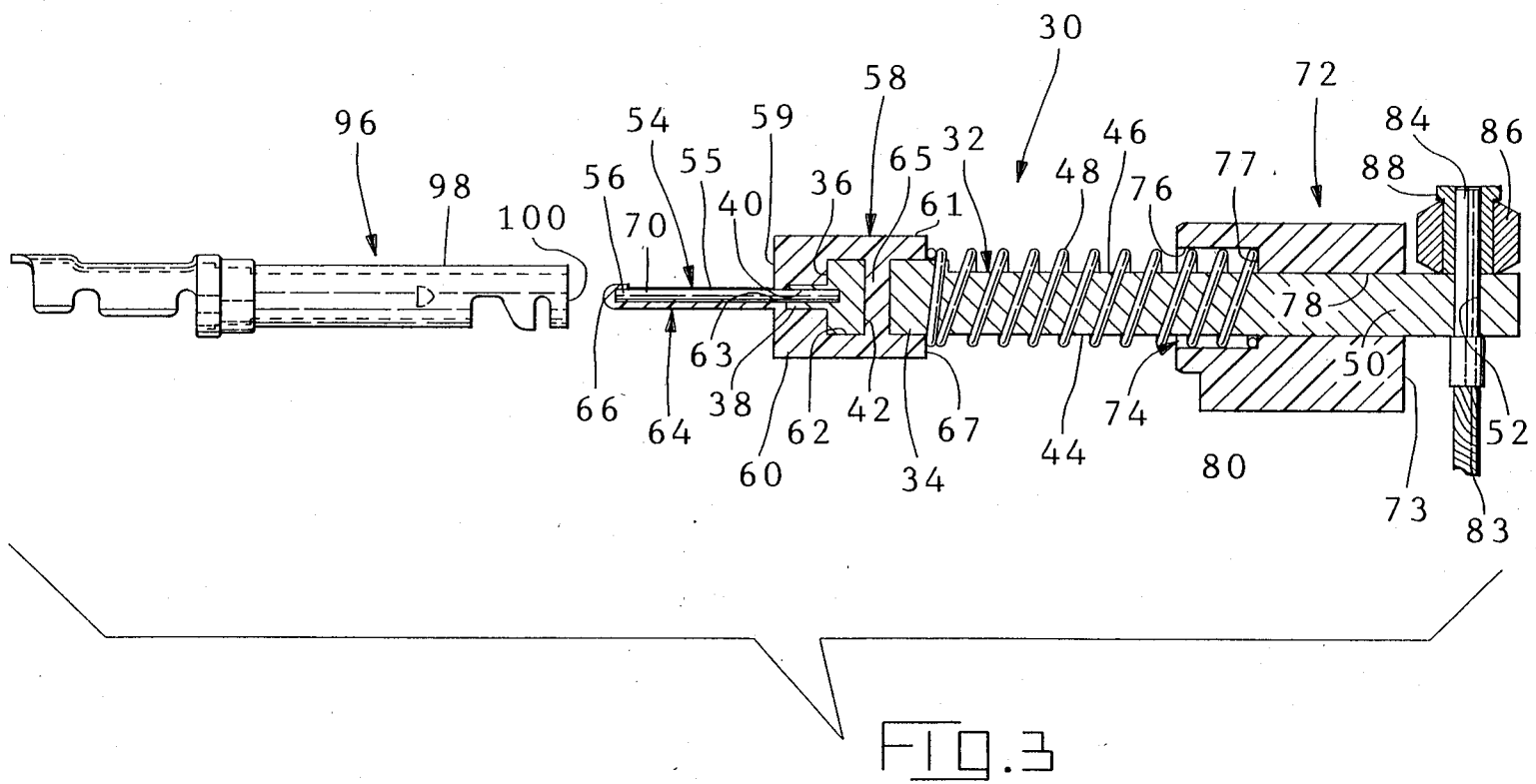
FIG. 3 is a cross sectional view of the assembled anode assembly of FIG. 2 having a terminal exploded therefrom.

Referring now to FIGS. 2, 2A and 3, anode assembly 30 of the present invention is comprised of a conductive body member 32 having an anode means 54 extending forwardly from an end of member 32 and a dielectric body member 58 having a passageway 62 therethrough, as seen in FIG. 3, for receipt of anode means or member 54 and a forward extending portion defining sheath means 64 for anode means 54 and means for securing body member 58 to body member 32 such that the forward sheath means 64 extends coaxially around anode member 54. Anode assembly 30 further includes spring member 48, dielectric collar member 72, cam tracking roller 86 and conductive wire assembly 82.

Conductive body member 32 includes forward, middle and rearward portions 34, 44 and 50 respectively. Forward portion 34 has a front face or reference surface 36 between body member 32 and a forward reduced diameter anode receiving section 38 extending forwardly from front face 36 and concentric therewith. Anode receiving section 38 has a bore 40 for receiving anode member 54 therein. Anode member 54 is secured in bore 40 of anode receiving section 38 preferably by crimping, although other means may also be used. Forward conductive body portion 34 further includes a first radial aperture 42 therein for use in securing dielectric body member 58 thereto as best seen in FIGS. 2 and 3. Middle body or shank portion 44 includes a flat surface 46 which extends axially and rearwardly along a portion of one side of conductive body member 32. A spring member 48 is disposed over the middle or shank portion 44. The action of spring member 48 can best be seen by referring to FIGS. 8, 8A and 8B. Flat surface 46 extends along rearward body portion 50. Rearward portion 50 of conductive body member 32 further includes second radial aperture 52 for receiving means for securing dielectric collar 72 on conductive body member 32 and mounting cam roller 86 thereto.

Figure 8:
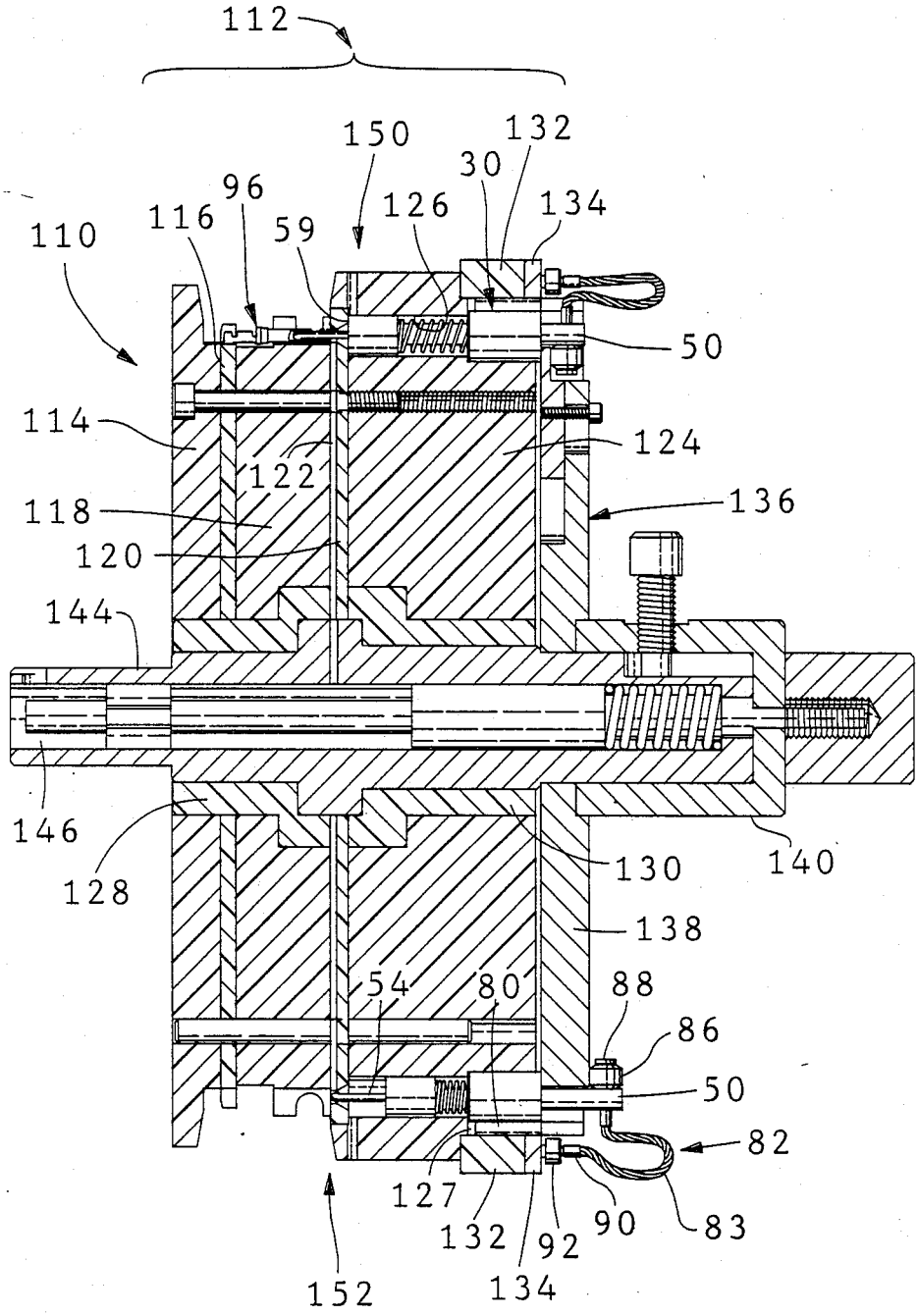
FIG. 8 is a cross-sectional view of a selective plating apparatus having the anode assemblies of the present invention mounted therein.
Figures 8A, 8B:
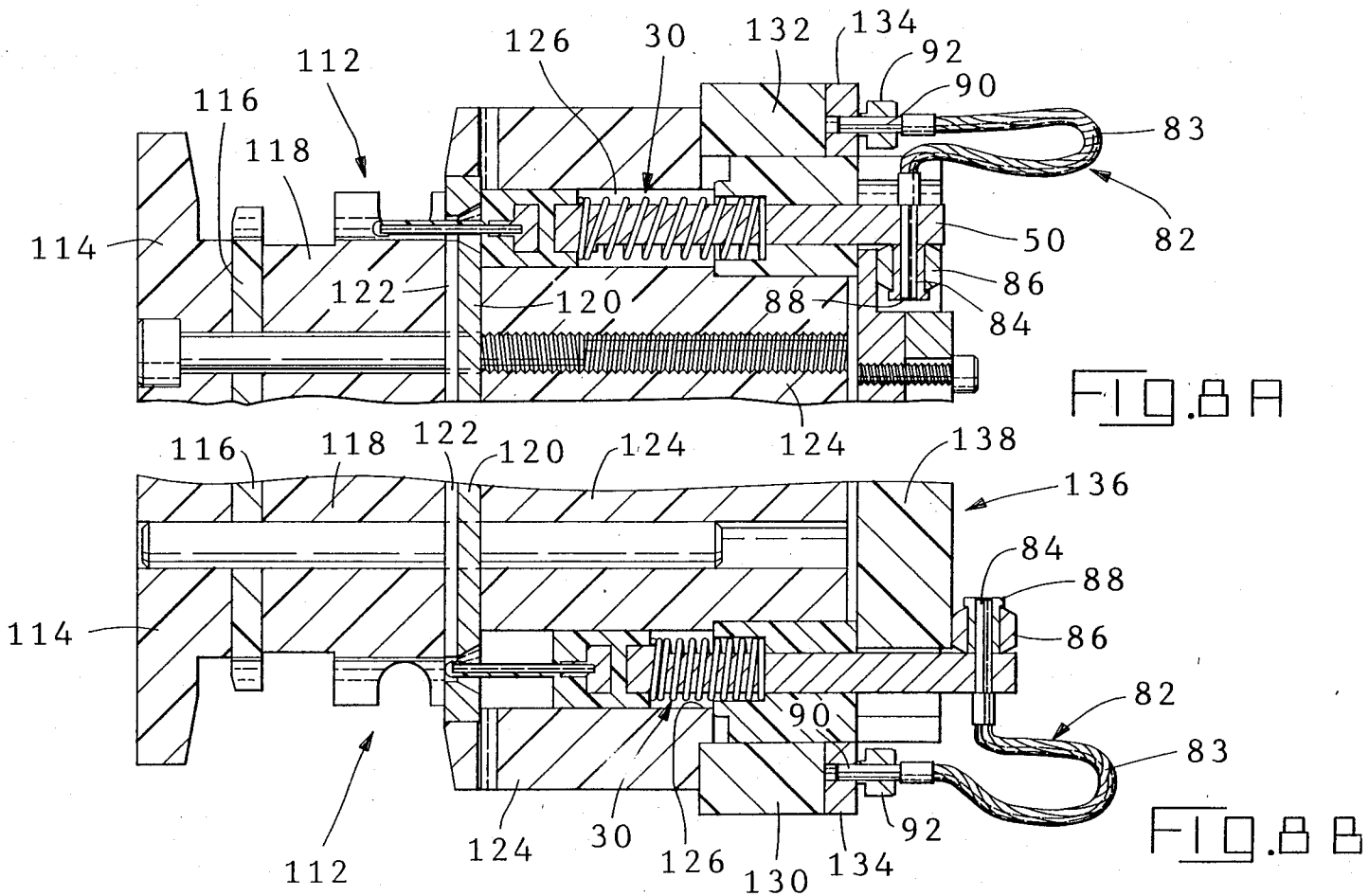
FIGS. 8A and 8B are enlarged fragmentary views of portions of the apparatus of FIG. 8 illustrating the anode assembly in its inserted and retracted positions

Dielectric collar member 72 as best seen in FIGS. 2, 2A and 3 is used to orient the anode assembly 30 in the plating apparatus as shown in FIGS. 8, 8A and 8B and to prevent rotation of the anode assembly 30 therein. In the preferred embodiment the means for securing the dielectric collar 72 to rearward conductive body portion 50 includes a conductor wire assembly 82 having a first pin 84 which is inserted through aperture 52 of body member 32 and secured thereto by a cam roller shaft 88. The other end of wire assembly 82 comprises a pin 90 which is securable to a conductive portion of the plating apparatus of FIG. 8 to provide a positive electrical connection during the plating process. Preferably wire assembly 82 includes member 92 which is used as an aid in inserting and removing pin 90 from the plating apparatus 110. In the preferred embodiment cam tracking roller 86 is also mounted on first pin member 84. Tracking roller 86 cooperates with a camming member of apparatus 110 of FIG. 8 to provide a means of retracting the anode member 54 from a terminal member 96. A detailed discussion of the plating apparatus of FIG. 8 is disclosed in U.S. Ser. No. 07/276,171 , and previously incorporated by reference herein. In the preferred embodiment, body member 32 is made of stainless steel and anode member 54 is preferably a platinum or platinum-iridium member.

Referring again to FIGS. 2, 2A and 3, dielectric body member 58 is comprised of a first portion 60 having a profiled passageway 62 therein dimensioned to receive the forward portion 34 of conductive body member 32 therein and the anode means 54 therethrough. Body member 58 further includes second portion 61 which extends rearwardly toward middle conductive body portion 44 and aperture 42 of conductive body member 32. In the preferred embodiment, second portion 61 includes plug portion 65 which fills aperture 42 and is used to secure dielectric body member 58 to conductive body member 32, as best seen in FIG. 3. Body member 58 further includes a forwardly extending portion 64 that extends along anode member 54 and ending in tip 66. Portion 64 extends around at least one selected circumferential portion of anode member 54, is concentric with conductive reference surface 36 and defines a sheath means 64 for anode member or means 54. The lateral edge surfaces 68 of sheath means 64 define at least one slot 70 extending along anode means 54 such that at least one axially extending portion 55 of anode means 54 is exposed along slot 70.

When anode assembly 30 is assembled, as best seen in FIG. 3, dielectric body member 58 is disposed over foward portion 34 of conductive body member 32 such that at least a section of the forward portion 34 including anode receiving section 38 and reference face 36 are enclosed by body member 58. The anode means extends along passageway 62 and through aperture 63 on the front face 59 of dielectric body member 58 and lies axially within sheath means 64. The first portion 56 of the anode means is surrounded by the tip 66 of sheath means 64 of body member 58 as can be seen in FIG. 3 with portion 55 of anode means 54 exposed along slot 70 of the sheath means 64. It has been found that the angular width of slot 70 in anode means 54 needs to be slightly narrower than the selected angular area to be plated on the interior surface of the terminal. For instance a slot of about 90 degrees will allow a selected plating surface comprising about 120 degrees of the interior barrel surface.

Figure 4:
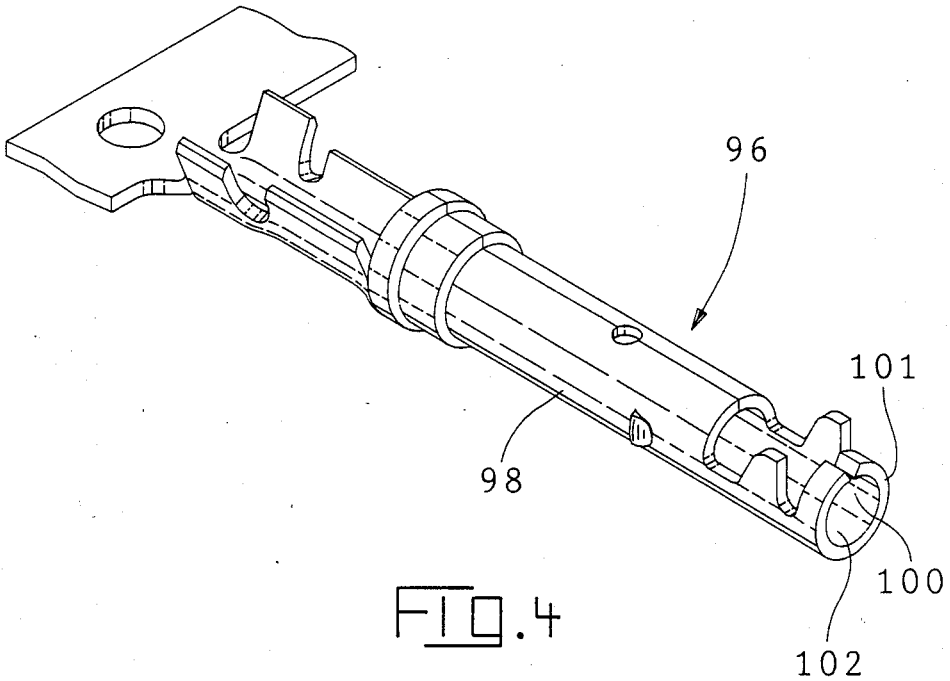
FIG. 4 is a perspective view of a terminal plated in accordance with the invention.
Figure 5:
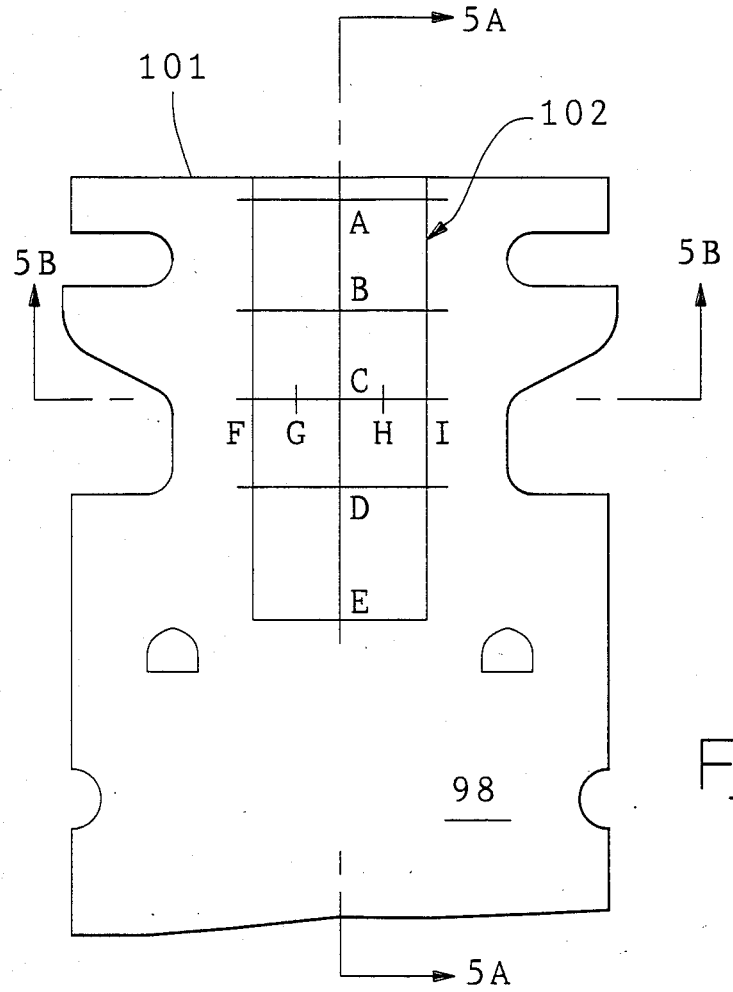
FIG. 5 is a plan view of the terminal of FIG. 4 having the terminal body opened to expose the contact area.

Preferably dielectric body member 58 is insert molded over the forward portion 34 of conductive body member 32, the dielectric material being molded around the forward portion and filling aperture 42 with plug portion 63 during the molding process thus securing the dielectric member 58 with conductive body member 32. It is to be understood that a separate body member could be molded having passageway 62 therein and an aperture adapted to be aligned with conductive body aperture 42. A separate plug member or other means could be used to secure the dielectric member to body 32. To prevent damage to anode means 54 during molding, dielectric portion 58 is preferably molded from a dielectric material having a very low rate of mold shrinkage. Furthermore, sheath means 64 must be capable of withstanding repeated insertions into terminals by movement of the spring member 48 against rear surface 67 of body 58, and in addition must be inert to plating solutions. Suitable materials include Vectra A130, a glass filled liquid crystal polymer, available from Celanese Specialty Operations. Other similar materials are also usable. It is to be understood that a dielectric body member and sheath means can be used with other anode embodiments. Dielectric body member 58 also includes a first stop surface 67 or "push surface" for spring member 48. The diameter of the combined shield means 64 and anode means 54 must be less than the diameter of the terminal 96 which is to be plated by the anode assembly 30, as best seen in FIG. 3. Referring now to FIGS. 3 through 5, terminal 96 includes barrel portion 98 having passageway 100 extending therethrough and selected angular contact region 102 as best seen in FIGS. 4 and 5.

Dielectric orientation collar member 72 as best seen in FIGS. 2 and 3 has a profiled passageway 74 therein having a larger first portion 76 and a smaller second portion 74. Collar member 72 further includes keying extension 80 which cooperates with the plating apparatus to stabilize the position of the anode assembly 30 and prevent rotation of the assembly 30 in apparatus. First portion 76 of passageway 74 is dimensioned to receive the end of the spring member 48, and provide a stopping surface 77 at the rearward end of first portion 76. Second portion 78 of passageway 74 is dimensioned to loosely receive the rearward portion 50 of conductive body member 32 therein. Dielectric collar 72 is slidably received on conductive body member 32 such that part of the rearward portion 50 including aperture 52 extends beyond the back face 73 of collar member 72. Collar member 72 is retained on body member 32 by inserting first pin 84 of conductive wire assembly 82 through aperture 52 and securing the first pin 84 to the upper surface 46 of rearward portion 50 a means of a cam tracking roller and roller shaft 86, 88 respectively. Since shaft portion 44 of conductive body 32 moves reciprocally within passageway 74 of member 72, it is preferred that collar member 72 be formed from a dielectric material that is suitable for making bearings. Such materials include DELRIN 500, DELRIN 500AF, acetal resins available from E.I. DuPont de Nemours & Co., and TEFZEL, a fluoropolymer also available from DuPont.

FIG. 8 illustrates a plating device 110 which uses anode assemblies 30 in its preferred embodiment. The details of this plating device are disclosed in copending U.S. Patent application Ser. No. 07/276,171. A mandrel plating apparatus 110 is comprised of a rotating dielectric section 112 and a stationary conductive section 136, both sections being mounted on conductive shaft member 144. Rotating dielectric section 112 is comprised of flange 114, stock drive index plate 116, socket index plate 118, nozzle plate 120 having a plurality of electrolyte passageways or nozzles 122 therein, cylinder manifold 124 having a plurality of anode chambers 126 therein, and bearing members 128 and 130. In the preferred embodiment rotating section 112 further includes dielectric wire collar mounting member 132 and conductive wire collar member 134 mounted to the outside of cylinder manifold 124. Wire mounting collar member 132 and Wire collar member 134 form means for terminating second pin members 90 of wire assembly 82 on respective anode assemblies 30 to provide positive electrical engagement between assemblies 30 and conductive portion 136.

Stationary conductive portion 136 of the apparatus is comprised essentially of cam member 138, and collar member 140 and is mounted on conductive shaft 144. Shaft 144 further has a conduit 146 for carrying the electrolyte solution under pressure through electrolyte passageways or nozzles 122 and over the exposed portions 55 of anode members 54 (shown in FIG. 3) of anode assemblies 30.

A plurality of anode assemblies 30 are mounted into anode assembly chambers 126 in cylinder manifold 124. Chambers 126 include stabilization slots 127 which receive key portions 80 of anode assemblies 30 as section 112 rotates, cam tracking roller 86 moves along camming surface of cam member 138 such that essentially half of the anode members or means 54 are engaged in terminals 96 at any one time. As shown in FIG. 8, anode assemblies 30 are engaged at position 150 and retracted at position 152. Preferably cam tracking roller 86 is a conductive material thus completing the positive electrical engagement between respective anode assemblies 30, conductive shaft 144 and cam member 138. Further details of this mechanism are described in the above-referenced patent application. FIGS. 8, 8A and 8B illustrate the use of anode assembly 30 in plating apparatus 110. In order to see the position of anode means 54 more clearly, terminal 96 is shown exploded from the apparatus 110.

As can be seen in FIGS. 8, 8A, 8B when the anode assembly 30 is in its forward position, as best seen in FIG. 8A, anode means 54 is moved into position to engage a terminal 96, (not shown), dielectric body member 58 is in a first position on the wheel and spring 48 is elongated. When the anode assembly 30 is in the first or inserted position, face 59 of first dielectric body portion 60 is positioned adjacent to the nozzle plate 120 of apparatus 110 such that the plating solution is forced through the electrolyte passageway or nozzle 122 proximate the front face 59 of body member 58, along the exposed surface 55 of the anode means 54 and sheath member 64. When the anode assembly 30 is in its retracted position as best seen in FIG. 8B, dielectric body member 58 is in a second position and spring member 48 is compressed. In its preferred embodiment, anode assembly 30 is moved from its inserted to its retracted position by means of the cam tracking roller 86 which follows a camming surface on cam member 138 of apparatus 110.

The combination of spring member 48, slidably mounted dielectric collar member 72, and cam tracking roller 86 provide a means for anode assembly 30 to be essentially "self-inserting". The energy retained by the spring member 48 when anode assembly 30 is in its retracted position as the cam tracking roller 86 moves from a first outward position abruptly to a second inner position along the cam surface is abruptly released allowing the spring member 48 to move forwardly against body 58, thus causing anode means 54 to move forward into passageway 100 of the terminal 96. As further seen in FIG. 8, the preferred embodiment of the present anode assembly further includes the conductive wire assembly 82 for providing positive electrical connection for the anode assembly. The details of this assembly is disclosed in U S. Pat. 4,690,747 and is incorporated by reference herein.

Figure 5A:
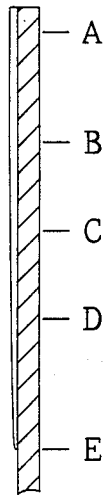
FIGS. 5A and 5B are cross sectional views of the contact area of the terminal of FIG. 5 taken along lines 5A—5A and 5B—5B respectively.
Figure 5B:
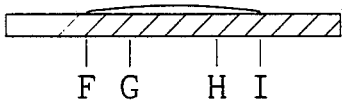

FIGS. 4, 5 and 5A illustrate one type of terminal 96 and the selected angular location 102 of the plating obtained by use of the present invention. Terminal 96 includes a contact area 102 inside passageway 100 of barrel portion 98. It is to be understood that this contact terminal 96 is merely representative of one type of barrel terminal plateable in an selected area within its barrel portion. FIGS. 5, 5A and 5B show the profile of the plated contact area of a terminal plated in accordance with the invention. As can be seen by FIGS. 5A and 5B, the plating has a tapered surface which is deposited along the axial length in the selected angular area of the terminal. The even thickness and abrupt tapered edges are characteristics of the plating deposit achieved by the selectively plating a terminal in accordance to the invention. The length of the plating deposit 102 substantially is equal to the length of the exposed anode means 54 within the terminal during the plating process. At the internal end or tip 66 of the sheath means 64, the charge and current density of the plating solution abruptly cease which causes an abrupt tapered edge to the plating deposit.

The present invention further relates to an electrical terminal member that has an angular selected area of the interior surface of that terminal plated with a precious of semi-precious metal layer applied using the anode assembly described in FIGS. 1-3 and in conjunction wth an apparatus such as that shown in FIG. 8. The layer has observable characteristics that distinguish it from characteristics of plating applied by processes other than that described herein. The standard requirement of the electrical industry is that an electrical receptacle of base metal such as copper or its alloy, should be plated first with nickel or one of it alloys, and then have its interior plated with a precious or semi-precious metal such as gold or cobolt-gold alloy to ensure electrical conductivity. Furthermore the plating must equal or exceed a specified thickness that allows for wear removable of the layer by abrasion in the contact area. For some types of receptacle terminals this contact area is only a portion of the internal surface of the terminal. Thus, plating applied to the remainder of the surface is unnecessary and it has been found to be much more cost effective to selectively plate a terminal only in the contact area where the electrical conductivity is required.

FIG. 5 depicts the angular selected portion of a terminal plated in accordance with the present invention. FIGS. 5A and 5B are cross sections taken along the lines 5A—5A and 5B—5B respectively of FIG. 5.

FIG. 5A illustrates the profile of the plated deposit along the axial center line from edge 101 of terminal 96 and to a depth of 0.200 inches. The deposit along the axial length of the deposit has a relatively even thickness until one approaches approximately 0.200 inches into the terminal where there is an abrupt and steep taper.

TABLE 1

| | (FIG. 5A) | |
|---|---|---|
| Location[1] | Depth[2] | Thickness[3] |
| A | 2 | 36.5 |
| B | 6 | 32.7 |
| C | 10 | 30.5 |
| D | 14 | 29.4 |
| E | 20 | 13.6 |

[1]Measurements are taken lengthwise along center line.
[2]In units of $1 \cdot 10^{-2}$ inches.
[3]In units of $1 \cdot 10^{-6}$ inches.

FIG. 5B illustrates the profile of the plated deposit around the annular portion of the circumference which in the example shown is 120°, 60° either side of the center line. As can be seen the thickness of the plating tapers abruptly at the outer angular locations. The thickness values given below represent average values for a number of samples.

TABLE 2

| Location[1] | (FIG. 5B) Distance[2] | Thickness[3] |
|---|---|---|
| F | 3 | 7.0 |
| G | 2 | 31.6 |
| H | 2 | 34.3 |
| I | 4 | 8.9 |

[1]Measurements are taken across the line at 0.100 inches.
[2]In units of $1 \times 10^{-2}$ inches.
[3]In units of $1 \times 10^{-6}$ inches.

There is an absence of the cobolt gold on the remaining surfaces of the interior of the receptacle. The even thickness and abrupt, tapered edges are characteristic of a plating deposit achieved by selective plating according to the invention. The length of the plating deposit is equal substantially to the length of the exposed portion of the anode that extends within the interior of the terminal. At the tip end of anode member 54, the charge and current densities abruptly cease, causing an abrupt tapered edge of the plating deposit. The plating deposit is substantially free of stress cracks and occousions, and has a grain structure characteristic of plating deposits.

Figure 6:
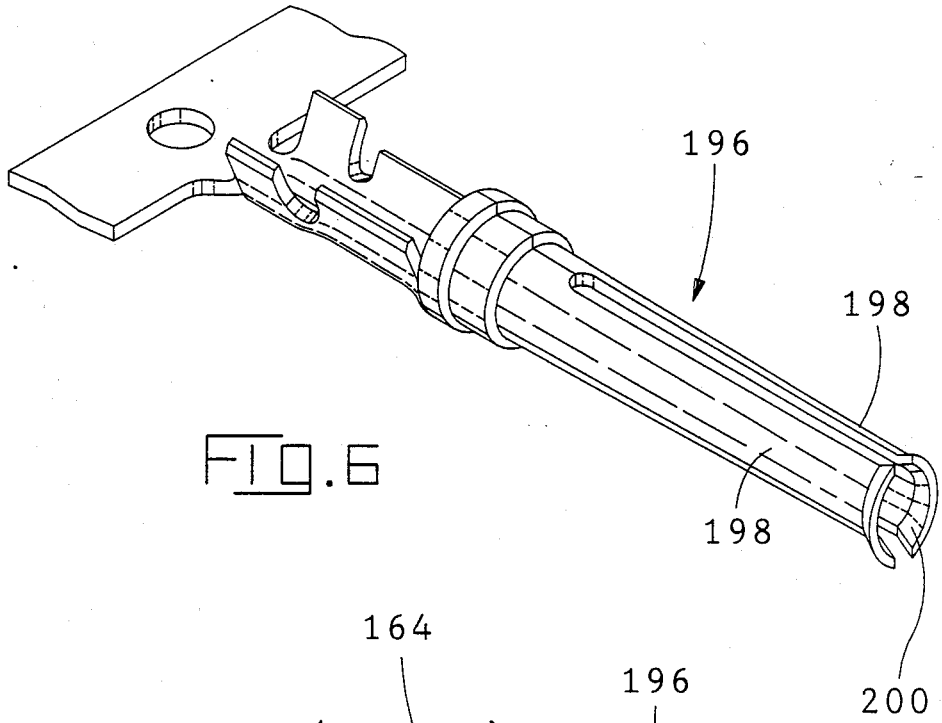
FIG. 6 is a perspective view of another embodiment of a terminal that may be plated in accordance with the invention.
Figure 7:
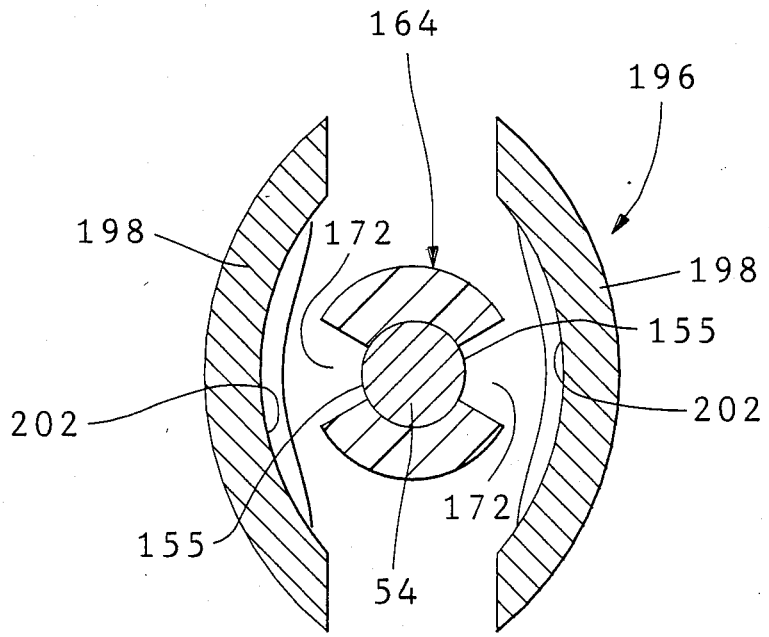
FIG. 7 is a cross sectional view of a terminal of FIG. 6 having an alternative anode assembly embodiment therein.

FIG. 6, 7 and 7A show alternative embodiments of the anode assembly 130 wherein shield member 164 has two slots 172 slot to provide for two selected angular areas 202 within the dual beam receptacle member 196. Receptacle member 196 includes dual beams 198 and passageway 200.

FIGS. 3 illustrates the beginning of the insertion of anode member 54 into terminal passageway 24. As anode assembly 30 is moved forward tip 66 enters passageway 100 and concentrically locates sheath and anode member 54 within the barrel terminal. By protecting member 56 tip 56 of anode member 54, the life of the anode is extended. Furthermore it is essentially impossible to have a short circuit when the anode assembly 30 is moved into the terminal since the dielectric tip 66 isolates the exposed anode portion from direct electrical contact with the internal surface of terminal 96. Since the tip 56 of the anode means 55 and portions of the outer surface are protected by dielectric sheath, there is much less chance of the anode being damaged by insertion into a non-aligned terminal. Since the angular portion of the internal surface of the terminal can be selectively plated in accordance with this invention, the amount of noble metal is considerably reduced thus making a more cost effective method of plating electrical terminals.

It is to be understood that the terminals, the exact shape of the anode bodies and sheath member are merely representative of the various shapes that might be used. It is further to be understood that the front of the terminal receiving portion of the sheath member may be reshaped to accommodate other terminal shapes.

It is thought that the anode assembly of the present invention and many of its attendant advantages will be understood from the foregoing description. It will be apparent that various changes may be made in the form, construction and arrangement of the parts thereof without departing from the spirit or scope of the invention or sacrificing all of its material advantages. The form herein described is merely a preferred or an exemplary embodiment thereof.

What is claimed is:

1. An anode assembly adapted for use in a plating cell and for selectively plating contact areas on the interior surface of socket terminals, said cell including means for providing a cathodic charge to said terminals, the anode assembly comprising:

a conductive body member having an anode means extending forwardly from a body section, said body section including a reference surface related to said anode means, said anode means being concentric with said reference surface;

a dielectric body member adapted to be secured to a forward portion of said conductive body member including said reference surface, said dielectric member having a passageway therethrough for receiving said anode means;

sheath means extending forwardly from said dielectric body member and along said anode means and extending angularly around at least one selected circumferential portion thereof and concentric with said conductive reference surface, lateral edge surfaces of said sheath means defining at least one slot extending axially along said anode means such that at least one axially extending portion of said anode means is exposed along said slot, said sheath means having a diameter smaller than the inner diameter of a terminal to be plated; and means securing said dielectric body member to said forward portion of said conductive body member;

whereby upon mounting said anode assembly in said plating cell, moving said sheathed anode means of said assembly into the interior of an electrical terminal, supplying plating solution upon said exposed anode portion of said anode means, and providing an electrical current flow from said anode means, through said solution and into said cathodically charges terminal, a layer of plating is selectively deposited on the internal surface portion of the terminal that is generally aligned with said at least one exposed anode portion, the sheath means providing a barrier to prevent plating on the remaining internal terminal surface portions.

2. The anode assembly of claim 1 wherein said dielectric body member is insert molded around said forward portion of said conductive body member.

3. The anode assembly of claim 1 wherein said lateral edge surfaces of said sheath means define two slots extending axially along said anode member such that two axially extending portions of said anode means are exposed along said slots.

4. The anode assembly of claim 1 wherein said assembly further includes a dielectric collar member slidably disposed on a rearward portion of said conductive body means.

5. The anode assembly of claim 4 wherein said collar member further includes means for stablizing the rotational position of said anode assembly in a plating apparatus.

6. The anode assembly of claim 1 wherein said anode assembly further includes a biasing means for moving said assembly toward a respective terminal in position to be plated when said anode assembly is in a plating apparatus and said anode assembly further includes means for retaining said biasing means on said assembly.

7. The anode assembly of claim 6 wherein said biasing means is disposed on an intermediate portion of said conductive body portion and said means for retaining includes a dielectric collar member slidably disposed on said conductive body rearwardly of said biasing means.

8. The anode assembly of claim 7 wherein said biasing means is a spring member which cooperates with surfaces on said dielectric body member to move said anode means into said electrical terminal.

9. The anode assembly of claim 1 wherein said anode assembly further includes means for providing a positive electrical connection with a conductive member of a plating apparatus.

10. The anode assembly of claim 1 wherein said anode assembly includes means for providing positive retraction of said anode means from said terminal.

* * * * *